US006345487B1

(12) United States Patent
Luciano et al.

(10) Patent No.: US 6,345,487 B1
(45) Date of Patent: Feb. 12, 2002

(54) HIGH QUALITY CONTROL TABLET FILLER DEVICE

(75) Inventors: Robert A. Luciano, Tewksbury Township, Hunterdon County; Lawrence W. Luciano, Clinton Township, Hunterdon County, both of NJ (US); Richard L. Smith, N. Coventry Township, Chester County, PA (US)

(73) Assignee: Luciano Packaging Technologies, Inc., Somerville, NJ (US)

( * ) Notice: Subject to any disclaimer, the term of this patent is extended or adjusted under 35 U.S.C. 154(b) by 0 days.

(21) Appl. No.: 09/418,784

(22) Filed: Oct. 15, 1999

(51) Int. Cl.[7] ..... B65B 57/00

(52) U.S. Cl. ..... 53/54; 53/55; 53/147; 53/244; 53/250; 53/501

(58) Field of Search ..... 53/54, 501, 55, 53/250, 244, 235, 237, 147, 154, 544, 437

(56) References Cited

U.S. PATENT DOCUMENTS

| | | | | |
|---|---|---|---|---|
| 3,871,295 A | | 3/1975 | Ackley | 101/426 |
| 3,889,591 A | | 6/1975 | Noguchi | 101/37 |
| 3,925,960 A | | 12/1975 | Saari et al. | 53/78 |
| 4,231,462 A | | 11/1980 | Ackley, Sr. et al. | 198/380 |
| 4,377,971 A | | 3/1983 | Ackley | 101/40 |
| 4,394,933 A | | 7/1983 | Ackley | 221/173 |
| 4,582,201 A | | 4/1986 | Taniguchi et al. | 209/587 |
| 4,619,360 A | | 10/1986 | Taniguchi et al. | 198/471.1 |
| 5,240,118 A | | 8/1993 | Mayer | 209/539 |
| 5,463,839 A | | 11/1995 | Stange et al. | 53/54 |
| 5,568,715 A | * | 10/1996 | Ebel et al. | |
| 5,596,865 A | * | 1/1997 | Kramer | |
| 6,185,901 B1 | * | 2/2001 | Aylward | |

* cited by examiner

*Primary Examiner*—Eugene Kim
(74) *Attorney, Agent, or Firm*—Kenneth P. Glynn

(57) ABSTRACT

The present invention tablet filler device with enhanced quality control features includes a tablet hopper and an agitating drum functionally connected to the hopper and adapted to regulate and orient gravity outflow of tablets. There is a gravity feed chute connected to and downstream from the hopper to singularly align and feed tablets, and a rotatable starwheel having slots to receive tablets individually from the feed chute so as to move tablets to a filling outlet for gravity feed to a container filling station.

20 Claims, 4 Drawing Sheets

HIGH QUALITY CONTROL TABLET FILLER DEVICE

BACKGROUND OF THE INVENTION

1. Field of the Invention

The present invention relates to tablet filler devices having enhanced quality control features. These tablet filler devices include a starwheel for filling which relies upon a stepper, tablet counting motor, tablet inspection mechanisms, unacceptable tablet ejection, counting confirmation sensors and closed system filling stations. These devices have high speed qualities, quality control redundancies and fool-proof aspects at the filling stations.

2. Information Disclosure Statement

The following patents are representative of the state of the art of filler devices:

U.S. Pat. No. 3,871,295 describes a capsule orienting and turning apparatus and method for use in a spin printing procedure in which a printing roll moves at a greater speed than the capsule, thus causing the capsule to rotate about its own axis while it is being printed. Many capsules, randomly arranged in a hopper, are picked up in a rotary conveyor which arranges them first in vertical arrangement relative to the path of movement of the conveyor, some capsules upright and some inverted, and an air jet shifts the body portions of the upright capsules in the machine direction so that the cap portions can subsequently be shifted in a sideways direction by a subsequent sideward-directed air jet. Those capsules which are inverted are not affected by the first air jet because of a barrier which prevents their movement; the cap portions of these inverted capsules are blown sideways by the sidewardly directed air stream. In this way, the positions of the capsules are rectified, with all of the cap portions on one side of the predetermined path and all of the body portions on the other side of the predetermined path.

U.S. Pat. No. 3,889,591 describes a branding machine for automatically printing indicia on tablets, pills, candies or any other products of any similar shape and/or size, which comprises a hopper unit, a feed unit including at least one rotary drum having the periphery formed with a plurality of radially inwardly recessed receptacles arranged in at least one row and a printer unit. The receptacles are successively communicated with a vacuum source for receiving the products therein under suction at first, then with a source of compressed air for posture correction of said products within the associated receptacles, again with the vacuum source for holding the posture-corrected products in a definite posture thereby to enable them to be printed by the printing unit, and finally with the compressed air source for successively ejecting the printed products on to a subsequent processing station. A method for reproduction of the indicia on the products.

U.S. Pat. No. 3,925,960 describes a machine for filling containers with discrete articles comprising a series of elongated slat members movable in a closed path, a portion of the slat members having an outer surface with a multiplicity of spaced apart cavities therein. The path comprises spaced apart cavity charging and discharging stations. Means at the charging station deposit articles in the cavities. The slat outer surfaces tilt at the discharge station for the simultaneous discharging of articles. Container delivery means continuously feed containers at a predetermined uniform speed along a line parallel to the direction of elongation of the slat members and below the level of slat members at the discharge station. A first set of stationary article-guiding chutes is disposed in side-by-side relation at said discharge station, each chute having an upper inlet and tapering to a narrowed outlet. A second set of chutes is supported for movement in a closed path, each chute being generally vertically disposed and having an upper inlet wider in the direction of chute travel than any first set chute outlet and a lower outlet smaller than its inlet. The closed chute path includes a portion extending the full length of the slat members with chutes in that path portion aligned with the container feeding line and the first set chute outlets. Drive means are provided for driving the container delivery means, for driving the chutes such that each chute moves with its outlet aligned with a moving container, and for driving the slat members.

U.S. Pat. No. 4,231,462 describes a turning and orienting apparatus of the type adapted to transport capsules in a plurality of pockets or the like, which pockets are formed in a continuously moveable transport conveyor, and wherein said apparatus is further adapted to rectify the capsules, which have body portions and cap portions of greater transverse dimensions than the body portions, and wherein a vacuum is provided to shift the capsules into the desired rectified position, a capsule portioning guide is provided to retain each capsule in its pocket immediately prior to its being subject to the vacuum. The capsule positioning guide then releases the capsule as it subjected to the vacuum. In a preferred embodiment of the invention, the capsule position is pivotally mounted adjacent the capsule transport conveyor so that it can be easily moved out of its operative condition adjacent the transport conveyor for easy cleaning thereof.

U.S. Pat. No. 4,377,971 describes an apparatus which is disclosed which transports and rectifies objects, such as pharmaceutical capsules, and prints appropriate indicia on the objects. The apparatus comprises a two-drum system, the first drum being used to shift objects from a radial to a longitudinal position, and then to reorient some of the capsule so that, when the capsules are delivered to a second drum, the cam drum, all capsules are pointing in the same direction. The system takes advantage of gravity for rectification. Spin printing means are provided to print indicia on the rectified objects, as the objects travel along the periphery of the cam drum. A process for operating the apparatus is disclosed.

U.S. Pat. No. 4,394,933 describes a capsule orienting apparatus in which misoriented asymmetric capsule inadvertently passed by a rectifying unit are segregated from properly oriented capsules. Capsules are delivered by a rectifying drum to capsules carrying pockets in a segregating drum which have recessed portions sized to loosely receive properly oriented capsules and tightly receive misoriented capsules. As the loosely held, properly oriented capsules pass a discharge point, they are released. The tightly held, misoriented capsules remain in the segregating drum past the discharge point and are ejected from the segregating drum downstream from the discharge point.

U.S. Pat. No. 4,582,201 describes a product transporting apparatus for transporting solid products of generally similar shape and/or size successively from a take-in station towards a take-out station, which has first and second rotary drums rotatable in the opposite directions to each other. The first and second rotary drums are of identical construction each having at least one circumferentially row of tubular receptacles protruding radially outwardly from the outer periphery of the respective drum and circumferentially equally spaced from each other. The products can be successively supplied onto the first rotary drum and held by suction in position on the tubular receptacles then communicated with a vacuum source at the take-in station, which are in turn transported, during the rotation of the drums, to the transfer station where they are released from the receptacles on the first drum then communicated with a compressed air source, onto the respective tubular receptacles on the drum then communicated with the vacuum source. The products so transferred onto the secondary drum are then transported in a similar fashion towards the take-out station where they are successively released from the second rotary drum onto a subsequent processing station.

U.S. Pat. No. 4,619,360 describes a product transporting apparatus for transporting solid products of generally similar shape and/or size successively from a take-in station towards a take-out station, which comprises first and second rotary drum rotatable in the opposite directions with each other. The first and second rotary drums are of identical construction each having at least one circumferential row of tubular receptacles protruding radially outwardly from the other periphery of the respective drum and circumferentially equally spaced from each other. The products can be successively supplied onto the first rotary drum and held in position sucked by the tubular receptacles then communicated with a vacuum source at the take-in station, which are in turn transported, during the rotation of the drums, to the transfer station where they are released from the receptacles on the first drum then communicated with a compressed air source, onto the respective tubular receptacles on the second rotary drum then communicated with the vacuum source. The products so transferred onto the second rotary drum are then transported in a similar fashion towards the take-out station where they are successively released from the second rotary drum onto a subsequent processing station.

U.S. Pat. No. 5,240,118 describes an apparatus for feeding tablets in an aligned and uniformly oriented sequence onto a tablet measuring device, including a moveable turntable having a deflector for guiding the tablets to a circumferential edge, a guide member and plow assembly respectively aligned in parallel and spaced apart relationship, the guide member having longitudinally-spaced air jets and the plow assembly having respective edge surfaces for slidably guiding tablets to a uniform orientation, and including a gate for removing particles and broken tablets from the channel to prevent them from being conveyed onto the measuring system.

U.S. Pat. No. 5,463,839 describes an apparatus for packaging a pre determined quantity of objects and a counting device therefore is disclosed. The counting device includes a feed chute for singularizing objects, and the tray has at least one guide path including segments defining a direction of movement oriented at an angle with respect to the drive axis of the tray. The packaging apparatus includes the counting device and associated components and controls for the automatic, high speed filling of containers.

Notwithstanding the prior art, the present invention is neither taught nor rendered obvious thereby.

SUMMARY OF THE INVENTION

The present invention is a tablet filler device with enhanced quality control features. In one preferred embodiment, it includes a tablet hopper for filling with randomly positioned tablets of a predetermined size and shape. The tablet hopper has a base with an outlet for gravity outflow of tablets and has an agitating drum functionally connected to the outlet for regulation and orientation of gravity outflow of tablets from the hopper. There is also a feed chute connected to and downstream from the hopper for receiving tablets therefrom. The feed chute is arranged so as to singularly align and feed tablets in a fixed orientation by gravity feed, i.e. lines them up in a single row. The feed chute is sufficiently non-horizontal to permit gravity flow of tablets therethrough. At the lower end of the feed chute is a rotatable starwheel having a plurality of slots adapted to receive the tablets individually from the feed chute so as to move tablets from the feed chute to a filling outlet for gravity feed to a container filling station located below the filling outlet. The container filling station is located below the filling outlet of the starwheel.

Additionally, there is a tablet inspection means located on the feed chute with sufficient discrimination capabilities to discern quality characteristics of tablets moving down the feed chute in accordance with a predetermined standard. The standard may be broken tablets, sizes of tablets, shape of tablets, color or other characteristics, and is likely a combination of two or more of these characteristics. The tablet inspection means includes means to identify unacceptable tablets and to communicate with a tablet ejector for ejection of the unacceptable tablets. The tablet ejector is adapted to eject unacceptable tablets from the feed chute in response to signals from the tablet inspection means. There is also stepper drive motor with a counter means for driving the starwheel in a step fashion for controlled release of tablets via the filling outlet and for counting tablets released from the filling outlet.

In preferred embodiments, the tablet filler device also includes a controller computer connected to the stepper motor to start and stop the motor to operate the starwheel so as to fill a container with a predetermined number of tablets. Also, the tablet inspection means preferably includes a camera and a computer connected to both the camera and the tablet ejector the computer may be the same as the controller computer for the step up motor, separate from it, but contains sufficient software to receive feedback data from the camera, compare the feedback data from the camera with predetermined standards, and recognize each tablet inspected which does not meet the predetermined standards as unacceptable by sending ejection signals to the tablet ejector so as to activate and eject each unacceptable tablet.

In other preferred embodiments, the container filling station includes a closed staging chamber connected to the filling outlet of the starwheel for hold up of released tablets until a predetermined number of tablets have been released to fill a container. This staging chamber has a shutter base adapted to open and close in coordination with positioning thereunder of sequential containers to be filled, coupled with attainment of the required predetermined number of tablets to fill a container. Thus, the container filling station includes a diving nozzle for insertion into and extraction from necks of containers to be filled so as to prevent any tablets from exiting or dropping out between the starwheel and the container. In other words, the closed staging chamber and a nozzle, especially a diving nozzle, prevents any opportunity for tablet loss between the starwheel with counter, and the container. The container filling station may also include a tablet count verification sensor below the starwheel counter to compare and confirm the tablet count, e.g. an electric eye, motion sensor or other sensor.

Since containers may be moved into the filling station with unique identifiers, e.g. on pucks or other holders with unique indicia, the container filling station may include an RF reader or other unique identifying means for identifying and tracking each container as it proceeds through the container filling station.

In yet other preferred embodiments of the present invention, the tablet filler device may have a plurality of feed chutes connected to the hopper. In some cases there will be separate starwheels, tablet inspection means, ejectors, filling stations, etc. for each of the plurality of feed chutes. In other cases, the tablet filler device includes a plurality of feed chutes connected to one another to form a single end feed chute upstream from the tablet inspection means and these and other components are arranged only once sequentially for a single filling station.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figures 1, 2:
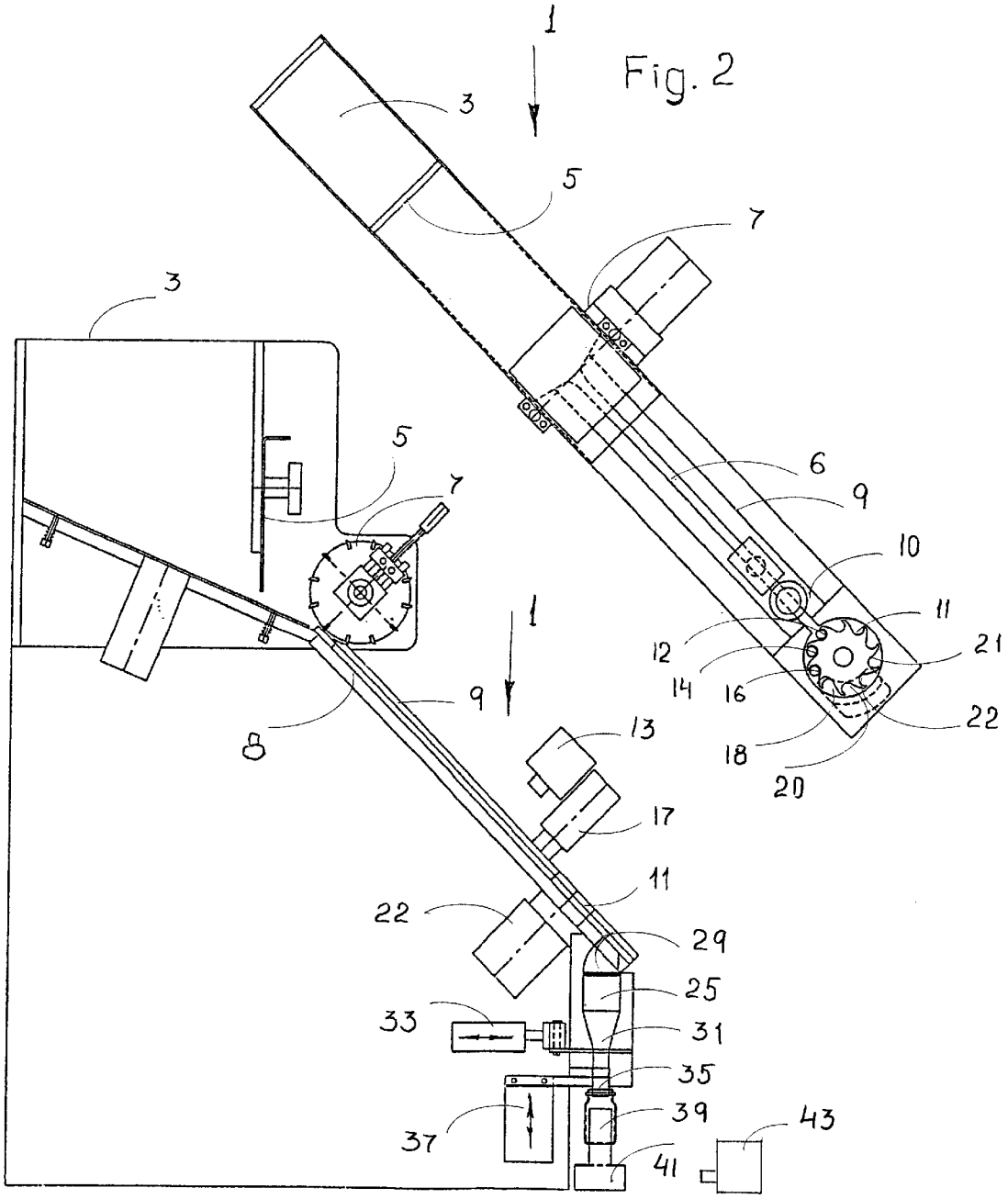
FIG. 1 shows a side view.
FIG. 2 shows a partial top view of a present invention single feed chute, quality control enhanced tablet filler device.

Referring to FIGS. 1 and 2, there is shown a side view and a partial top view of a present invention high quality control tablet filler device 1. It includes a tablet supply hopper 3 with an adjustable exit gate 5 and rotating drum 7 for unitary release of tablets in an oriented fashion. The drum 7 is functionally connected to hopper 3, as shown. Gravity feed chute 9 with channel 16 is connected at its upper end 8 to hopper 3 and drum 7 and at its lower end 10 to rotatable starwheel 11, having a sawblade-like profile with endpoints biased towards a direction of rotation with a plurality of slots located between these points which are adapted to receive individual tablets. Upstream from rotatable starwheel 11 is a tablet inspection means, in this case a camera 13 connected to communicating computer described below which instructs (activates) ejector 17 to eject an unacceptable tablet. This is determined by data from the camera for each tablet passing by with predetermined quality characteristics. Those which do not meet the characteristics designated are deemed unacceptable and are ejected (e.g. by vacuum or catch and movement). This is a critical quality control feature of the present invention device and system, and may be based on any recognizable characteristic or combination thereof desired, e.g. color, shape, composition, fracture, printed code, etc. Alternatively, the camera ejector may be located above the star wheel and, therefore in some embodiments, inspection and ejection will take place at the starwheel. Additionally, the inspection means such as the camera mentioned above may include surge assurance features, i.e., sensing that tablets continue to feed and stake the chute. This also could be done with a separate device, e.g. with optical fiber(s).

Figure 3:
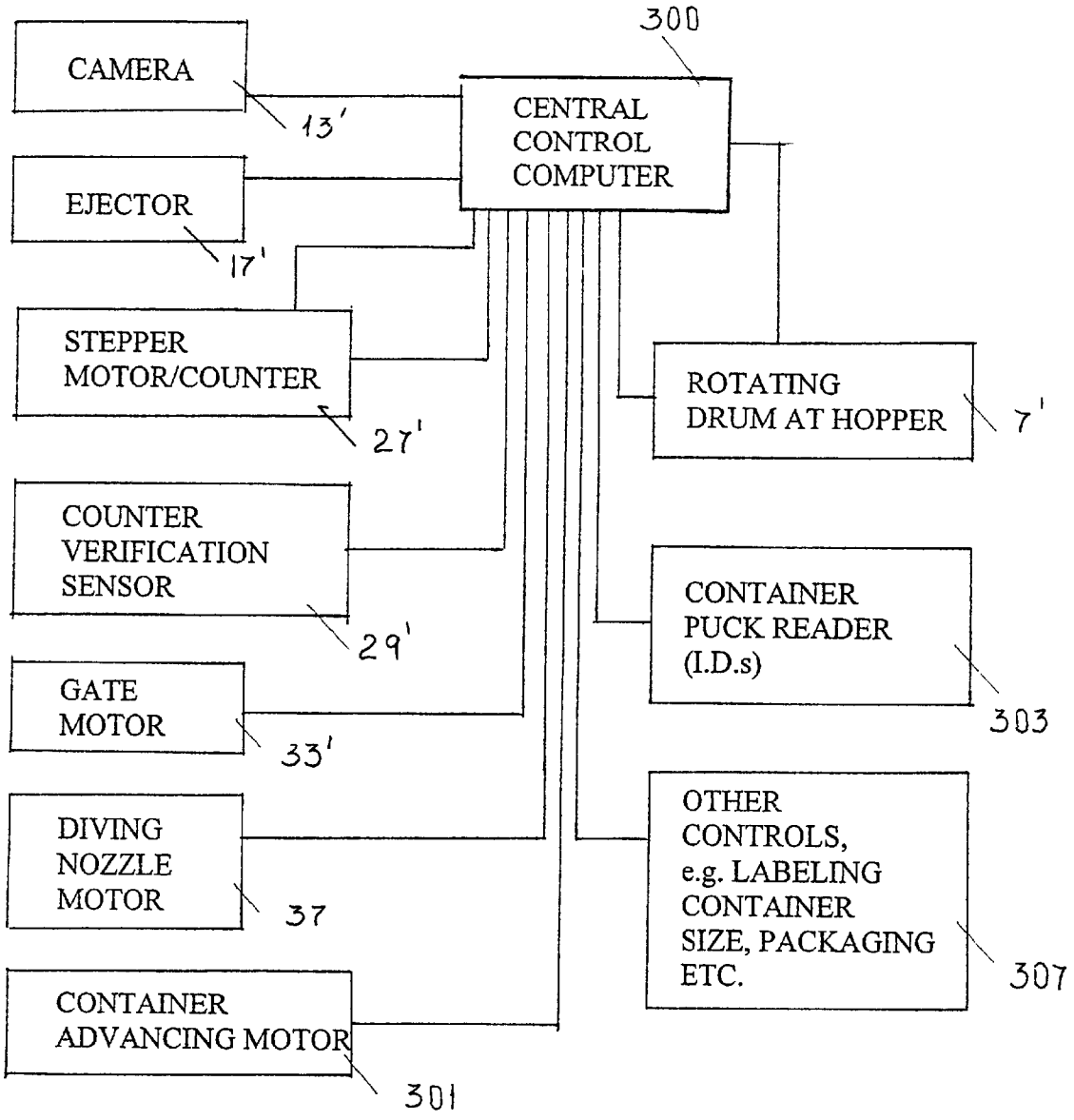
FIG. 3 shows a top view of details of a present invention tablet filler device having a single hopper and plural parallel feed chutes and includes details of the container filling station and container rejection mechanisms; and, FIGS. 4 and 5 show from views of alternative embodiment present invention tablet filler device plural feed chute arrangements.

Gravity feed chute 9 is in a non-horizontal position to permit gravity flow of tablets to rotating starwheel 11 with tablet receiving catch protrusions such as catch protrusion 21. Thus, in FIG. 2 tablet 12 is shown entering rotating starwheel 11 and tablets 14, 16, 18 and 20 are rotating counterclockwise but could alternatively be clockwise. Tablet 22 is dropping through an orifice under rotating starwheel 11 into closed staging chamber 25 (FIG. 1). There is also a stepper motor 27 which moves in a step-wise fashion to stop, pick up a tablet, move forward to the next position, stop, pick up another tablet, etc. Alternatively, and in some preferred embodiments, the starwheel is designed and coordinated with tablet flow to permit continuous operation. Stepper motor 27 acts not only to control and operate starwheel 11, but also operates as a counter of tablets with feedback to a computer (FIG. 3). Tablets such as tablet 22 drop by gravity into staging chamber 25 and an option count verification sensor 29 keeps an independent count of the descending tablets and verifies the count by stepper motor 27.

In this embodiment, there is a shutter base or gate 31 which operates for fill escapement by gate motor 33. Thus, starwheel 11 will stop and gate motor 33 will open gate 31 when staging chamber 25 reaches a predetermined count level of tablets to fill a container, determined by the counter feature of stepper motor 27 and verified by the counter verification sensor 29 and there is a counter for filling positioned below. (In some embodiments, a container confirming sensor may be included which would prevent the gate from opening when no container is present.) Once the tablets in staging chamber 25 have descended into the container 39 below, gate 31 will close and starwheel 11 will commence.

Also, in this embodiment is a diving nozzle 35 controlled by actuator 37. Thus, diving nozzle 35 is positioned downwardly by actuator 37 when an empty container such as container 39 is to be filled and is being filled. When container 29 is filled and gate 31 is closed, diving nozzle 35 is moved to its up position and a new container is moved to the filling area below diving nozzle 35.

Additionally, containers such as container 39 may be mounted or held by a holder or puck such as puck 41 which may have unique identifiers. For example, each puck may have a unique bar code or unique RF tag and would be read by a sensor such as a bar code scanner or RF reader 43 for identifying and tracking each container as it passes through each filling area.

FIG. 3 shows a block diagram for the computer control system of the present invention and each block which relates to a component shown in FIG. 1 and/or FIG. 2 has identifying numbers followed by a prime. Thus, central control computer 300 is connected to all of the above identified components as shown in FIG. 3 to uniquely control and coordinate and harmonize all of the features described above. Additionally, there would be a container advancing conveyor 301 controlled by central control computer 300 to synchronize its operation with the inspection, ejection, starwheel counter, counter verification and other filling station operations. A container puck reader 303 would provide identifying information for each container to the computer 300 for tracking, labelling, quality control and other purposes. Finally, block 307 represents other controls which may be controlled with the central computer such as labeling, container size and filler quantity changes, grouping and packaging automated systems and even tablet size, dosage or type of tablet changes.

Figure 4:
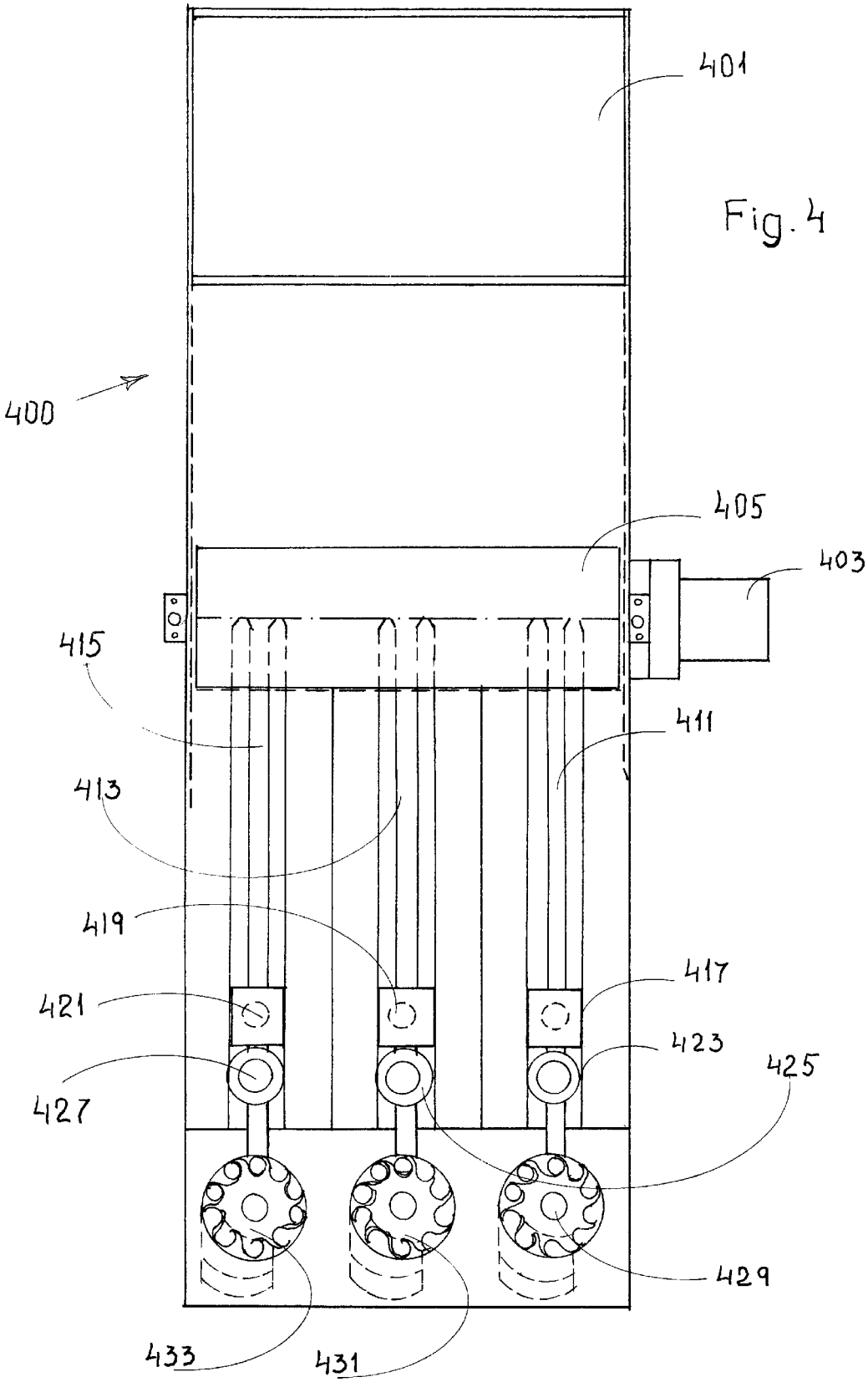

FIG. 4 shows a present invention embodiment top view device 400 having a single hopper 401 but with multiple gravity feed chutes. Thus, gravity device 400 includes a drive motor 403 and one drum 405. There. are three gravity feed chutes 411, 413, and 415; three inspection devices 417, 419 and 421; three ejectors 423, 425 and 427; and, three starwheels 429, 431, and 433 with a separate motor for each starwheel which is independently controlled. (Other aspect such as filling station 401 may be included, but are not shown). Using device 400, a single hopper may have triple the filling capabilities on a per hour or per day basis by virtue of filling three containers sideby-side simultaneously.

Figure 5:
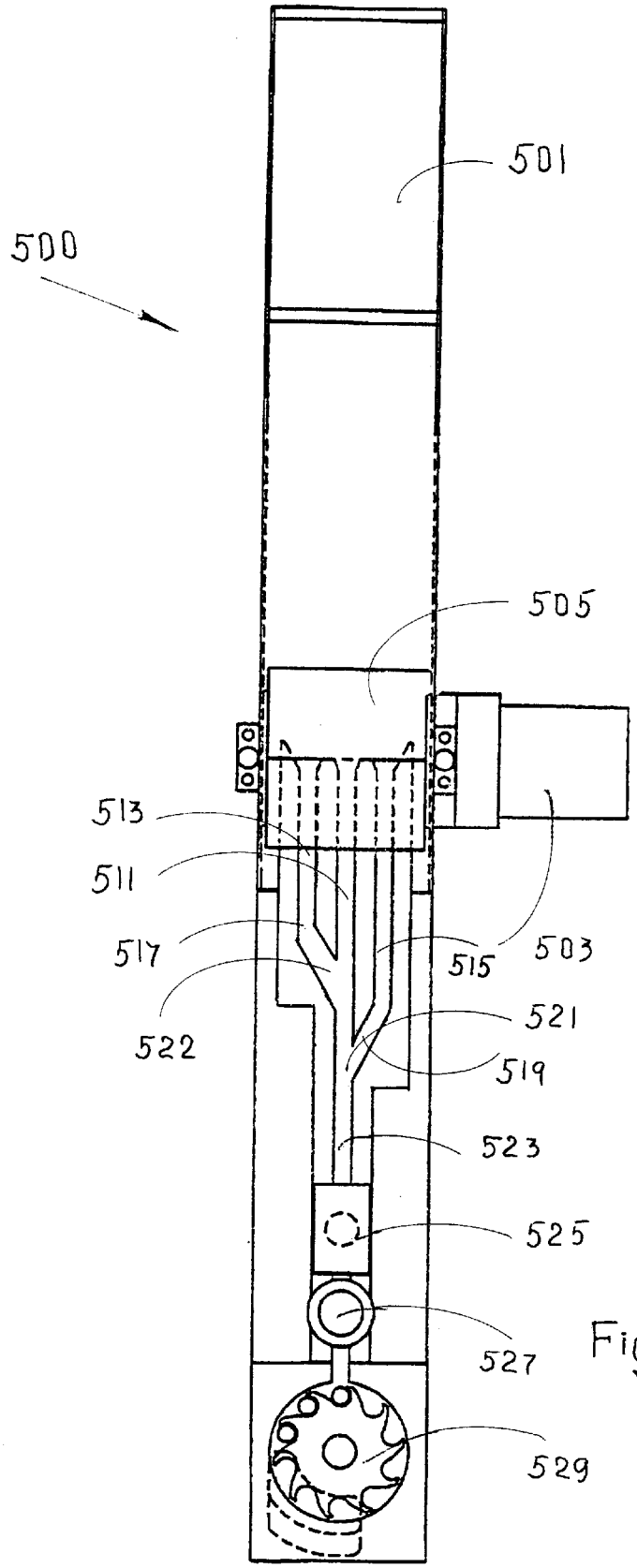

FIG. 5 shows a top view of present invention high quality control tablet filler device 500 having a single hopper 501 and here having a manifolding system is utilized to guarantee that the gravity feed chute always provides a full line of tablets. Thus, there is a drum 505, driven by motor 503 and three upper gravity feed chutes 511, 513 and 515. However, in this device 500, the individual upper gravity feed chutes 511, 513 and 515 converge to central chute 511 via traversals 517 and 519 in a manifolding fashion to junctions 521 and 522, whereafter all incoming tablets ultimately flow down single lower feed chute 523. Since the convergence occurs upstream from the inspections, ejections, counting, etc., only a single inspecting mechanism 525 and ejecting mechanism 527 is required. (Alternatively, three separate inspecting and ejecting means could be utilized upstream from junction 521.) Likewise, a single starwheel 529 and filling station (not shown) similar to FIGS. 1 and 2 would be utilized.

It can now be seen that by the above invention, in its various embodiments, that a more mechanically simplified, yet quality control sophisticated tablet filler device has been provided that has not heretofore been developed in the industry.

Obviously, numerous modifications and variations of the present invention are possible in light of the above teachings. For example, the reference to a central control computer herein may be taken to mean a single computer connected to all aspects of the invention or a plurality of computers performing collectively the same functions as a single computer. It is therefore understood that within the scope of the appended claims, the invention may be practiced otherwise than as specifically described herein.

What is claimed is:

1. A tablet filler device with enhanced quality control features, which comprises:

(a) a tablet hopper for filling with randomly positioned tablets of a predetermined size and shape, said tablet hopper having a base with an outlet for gravity outflow of tablets;

(b) an agitating drum functionally connected to said outlet and adapted to regulate and orient gravity outflow of tablets from said hopper;

(c) a feed chute connected to and downstream from said hopper for receiving tablets therefrom and adapted to singularly align and feed tablets in a fixed orientation by gravity feed, said feed chute being sufficiently non-horizontal to permit gravity flow of tablets therethrough;

(d) a rotatable starwheel having a sawblade-like profile with endpoints biased towards a direction of rotation and a plurality of slots there between which are adapted to receive tablets individually from said feed chute so as to move tablets from said feed chute to a filling outlet for gravity feed to a container filling station located below said filling outlet;

(e) a container filling station located below said filling outlet of said starwheel;

(f) tablet inspection means located on at least one of said feed chute or said rotatable starwheel and having sufficient discrimination capabilities to discern quality characteristics of tablets moving down said feed chute in accordance with a predetermined standard including means to identify unacceptable tablets and communicate with a tablet ejector for ejection of unacceptable tablets;

(g) a tablet ejector in communication with said tablet inspection means adapted to eject unacceptable tablets from said feed chute in response to signals from said tablet inspection means; and, (h) a stepper drive motor with a counter means for driving said starwheel in a step fashion for controlled release of tablets via said filling outlet and for counting tablets released from said filling outlet of said starwheel.

2. The tablet filler device of claim 1 wherein said device also includes a controller computer connected to said stepper motor to start and stop said motor to operate said starwheel so as to fill a container with a predetermined number of tablets.

3. The tablet filler device of claim 1 wherein said tablet inspection means includes a camera and a computer connected to both said camera and said tablet ejector said computer containing sufficient software to receive feedback data from said camera, compare feedback data from said camera with predetermined standards, recognize each tablet inspected which does not meet said predetermined standards as unacceptable by sending ejection signals to said tablet ejector so as to activate and eject each unacceptable tablet.

4. The tablet filler device of claim 1, wherein said container filling station includes:

a closed staging chamber connected to said filling outlet of said starwheel for hold up of released tablets until a predetermined number of tablets have been released to fill a container, said staging chamber having a shutter base adapted to open and close in coordination with positioning thereunder of sequential containers to be filled.

5. The tablet filler device of claim 1 wherein said container filling station includes a diving nozzle for insertion into and extraction from necks of containers to be filled.

6. The tablet filler device of claim 4 wherein said container filling station includes a diving nozzle for insertion into and extraction from necks of containers to be filled.

7. The tablet filler device of claim 1 wherein said container filling station includes a tablet count verification sensor.

8. The tablet filler device of claim 4 wherein said container filling station includes a tablet count verification sensor.

9. The tablet filler device of claim 1 wherein said container filling station includes an RF reader for identifying and tracking each container as it proceeds through said container filling station.

10. The tablet filler device of claim 4 wherein said container filling station includes an RF reader for identifying and tracking each container as it proceeds through said container filling station.

11. The tablet filler device of claim 1 wherein there is a plurality of feed chutes connected to said hopper and connected to one another to form a single end feed chute upstream from said tablet inspection means.

12. The tablet filler device of claim 11 wherein said device also includes a controller computer connected to said stepper motor to start and stop said motor to operate said starwheel so as to fill a container with a predetermined number of tables.

13. The tablet filler device of claim 11 wherein said tablet inspection means includes a camera and a computer connected to both said camera and said tablet ejector said computer containing sufficient software to receive feedback data from said camera, compare feedback data from said camera with predetermined standards, recognize each tablet inspected which does not meet said predetermined standards as unacceptable by sending ejection signals to said tablet ejector so as to activate and eject each unacceptable tablet.

14. The tablet filler device of claim 11 wherein said container filling station includes:

a closed staging chamber connected to said filling outlet of said starwheel for hold up of released tablets until a predetermined number of tablets have been released to fill a container, said staging chamber having a shutter base adapted to open and close in coordination with positioning thereunder of sequential containers to be filled.

15. The tablet filler device of claim 11 wherein said container filling station includes an RF reader for identifying and tracking each container as it proceeds through said container filling station.

16. A tablet filler device with enhanced quality control features, which comprises:

(a) at least one tablet hopper for filling with randomly positioned tablets of a predetermined size and shape, said tablet hopper having a base with an outlet for gravity outflow of tablets;

(b) at least one agitating drum functionally connected to said outlet and adapted to regulate and orient gravity outflow of tablets from said hopper;

(c) a plurality of feed chutes connected to and downstream from said hopper for receiving tablets therefrom and adapted to singularly align and feed tablets in a fixed orientation by gravity feed, said feed chute being sufficiently non-horizontal to permit gravity flow of tablets therethrough;

(d) at least one rotatable starwheel having a sawblade-like profile with endpoints biased towards a direction of rotation and a plurality of slots there between which are adapted to receive tablets individually from said feed chute so as to move tablets from said feed chute to a filling outlet for gravity feed to a container filling station located below said filling outlet;

(e) at least one container filling station located below said filling outlet of said starwheel;

(f) at least one tablet inspection means located on at least one of said feed chute or said rotatable starwheel and having sufficient discrimination capabilities to discern quality characteristics of tablets moving down said feed chute in accordance with a predetermined standard including means to identify unacceptable tablets and communicate with a tablet ejector for ejection of unacceptable tablets;

(g) at least one tablet ejector in communication with said tablet inspection means adapted to eject unacceptable tablets from said feed chute in response to signals from said tablet inspection means; and, (h) at least one stepper drive motor with a counter means for driving said starwheel in a step fashion for controlled release of tablets via said filling outlet and for counting tablets released from said filling outlet of said starwheel.

17. The tablet filler device of claim 16 wherein for each of said plurality of feed chutes there are the following separate items: (d) rotatable starwheel; (e) container filling station; (f) tablet inspection means; (g) tablet ejector; (h) stepper drive motor.

18. The tablet filler device of claim 17 wherein said device also includes a controller computer connected to said stepper motor to start and stop said motor to operate said starwheel so as to fill a container with a predetermined number of tablets.

19. The tablet filler device of claim 17 wherein said tablet inspection means includes a camera and a computer connected to both said camera and said tablet ejector said computer containing sufficient software to receive feedback data from said camera, compare feedback data from said camera with predetermined standards, recognize each tablet inspected which does not meet said predetermined standards as unacceptable by sending ejection signals to said tablet ejector so as to activate and eject each unacceptable tablet.

20. The tablet filler device of claim 17 wherein said container filling station includes:

a closed staging chamber connected to said filling outlet of said starwheel for hold up of released tablets until a predetermined number of tablets have been released to fill a container, said staging chamber having a shutter base adapted to open and close in coordination with positioning thereunder of sequential containers to be filled.

* * * * *